United States Patent [19]

Lindstrom

[11] Patent Number: 4,795,396

[45] Date of Patent: Jan. 3, 1989

[54] SPIN TOY LAUNCHER

[76] Inventor: Oscar F. Lindstrom, 658 Santa Marguerita, Goleta, Calif. 93117

[21] Appl. No.: 113,637

[22] Filed: Oct. 27, 1987

[51] Int. Cl.[4] ..... A63H 1/06; A63B 71/00

[52] U.S. Cl. ..... 446/259; 273/129 P; 273/129 Q

[58] Field of Search ..... 124/78, 27; 273/129 P, 273/129 Q; 446/255-259

[56] References Cited

U.S. PATENT DOCUMENTS

| | | | |
|---|---|---|---|
| 532,678 | 1/1895 | Martin | 446/259 |
| 602,019 | 4/1898 | Steppan | 446/259 |
| 753,051 | 2/1904 | Drescher | 446/259 |
| 2,401,866 | 6/1946 | Greenwood | 446/259 |
| 3,408,766 | 11/1968 | Ajero | 446/255 |
| 3,498,612 | 3/1970 | Ellis | 446/259 |
| 4,016,854 | 4/1977 | Lehman | 124/27 |

*Primary Examiner*—Robert A. Hafer
*Assistant Examiner*—Michael Brown
*Attorney, Agent, or Firm*—Kenneth J. Hovet

[57] ABSTRACT

A lever having an inner impeller arm and outer actuating arm is pivoted to a portable platform. An adjustably fixed post is secured to the platform radially outward from the impeller arm. The post includes a concave surface which faces a convex surface at the end of the impeller arm. At least a portion of the surfaces are mutually congruent and spaced-apart a distance less than the diameter of a top spindle. The surfaces are resilient and grip the spindle so that relative movement between the surfaces will rotate the spindle and top. As the impeller arm is swung beyond the stationary surface, the top will be released from the surfaces and become propelled by the arm into dynamic flight.

14 Claims, 3 Drawing Sheets

SPIN TOY LAUNCHER

BACKGROUND OF THE INVENTION

1. Field of the Invention

The invention relates to spinning toys and, more particularly, to launchers for tops.

2. Brief Description of the Prior Art

Other than using a string around the spindle of a top, prior art spinning devices have involved cumbersome mechanisms that generally require alterations to the top itself. The prior art mechanisms adequately function to spin the top, but are inadequate for propelling the top after spinning.

One of the simplest devices is shown in U.S. Pat. No. 2,401,866. Here, a toy gun is used whereby a rubber band and trigger arm engage separate notches in the top periphery. Pulling the trigger will release the top so the rubber band can spin the top about end slots in the gun barrel. However, to propel the spinning top out of the end slots, the gun must be swung, or otherwise thrust in a manner to throw the top in the desired direction.

In U.S. Pat. Nos. 1,060,612 and 1,133,756, the spindle of a top is provided with teeth to engage a toy pistol spin mechanism. In both of the patented mechanisms, the top is spun at the end of the piston barrel. Thereafter, however, the top is simply dropped from the barrel to the ground as it continuous to spin.

SUMMARY OF THE INVENTION

The present invention provides a unique assembly whereby a large variety of tops can be both spun and launched effectively and without the necessity of adapting the top to the assembly. The use of cumbersome mechanical linkages, triggers and springs are also avoided.

A lever, comprising an impeller arm and an actuating arm, is pivotally fixed to a base. The impeller arm includes a convex surface that functions as a top spindle gripping face. A post means is secured to the base which includes a stationary surface or face that is spaced radially apart from the convex surface. The distance between the surfaces is selectively determined to be less than the diameter of the spindle of a top to be launched. Relative movement of the surfaces with a spindle therebetween will spin and propel the top from the surfaces. Various connector means are used to initially position the top within the nip of the opposing surfaces.

DESCRIPTION OF THE PREFERRED EMBODIMENTS

Figure 1:
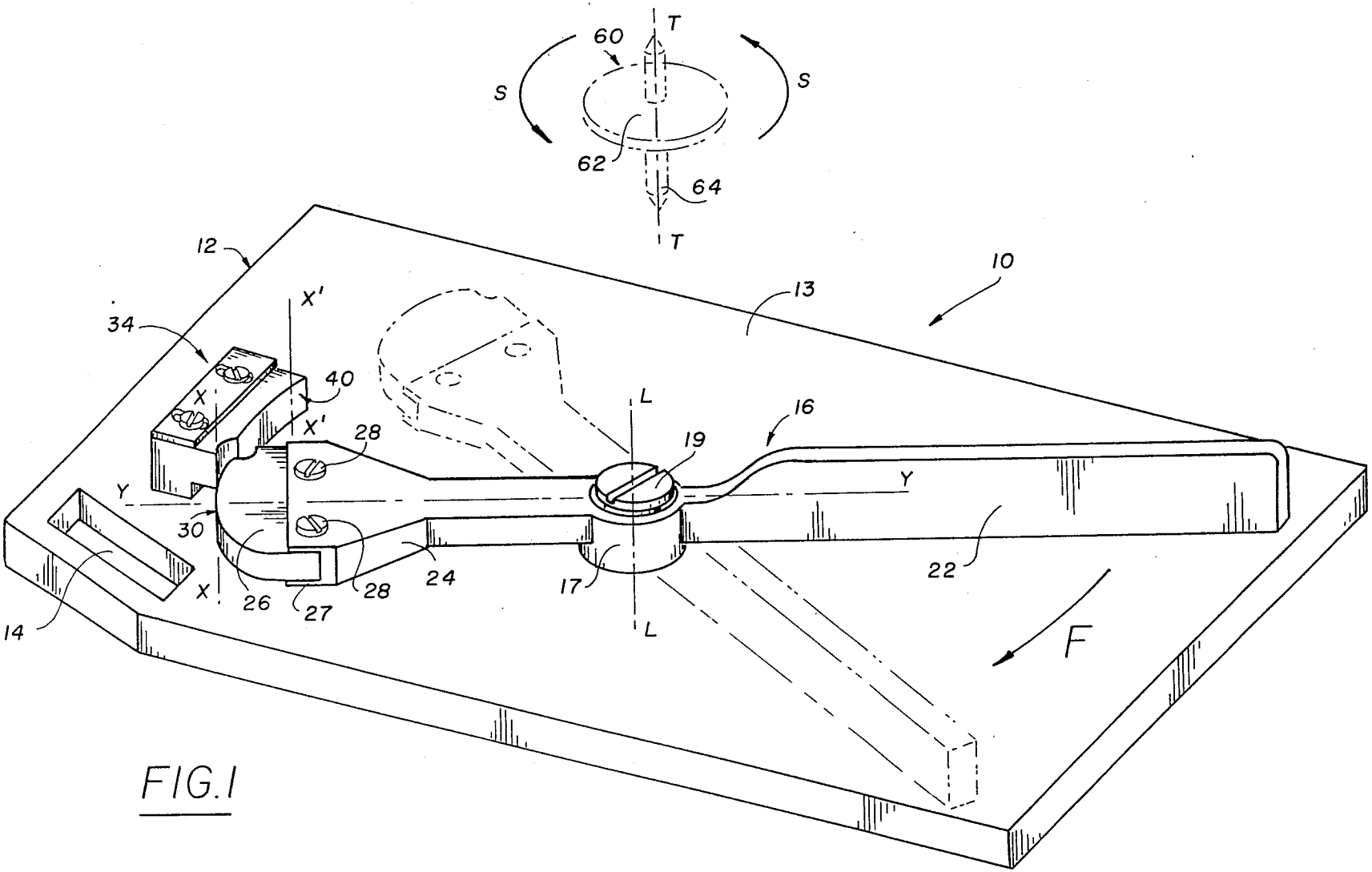
FIG. 1 is a perspective view of the invention showing a top spinning and launching assembly with a top and lever means in a prelaunch position.
Figure 2:
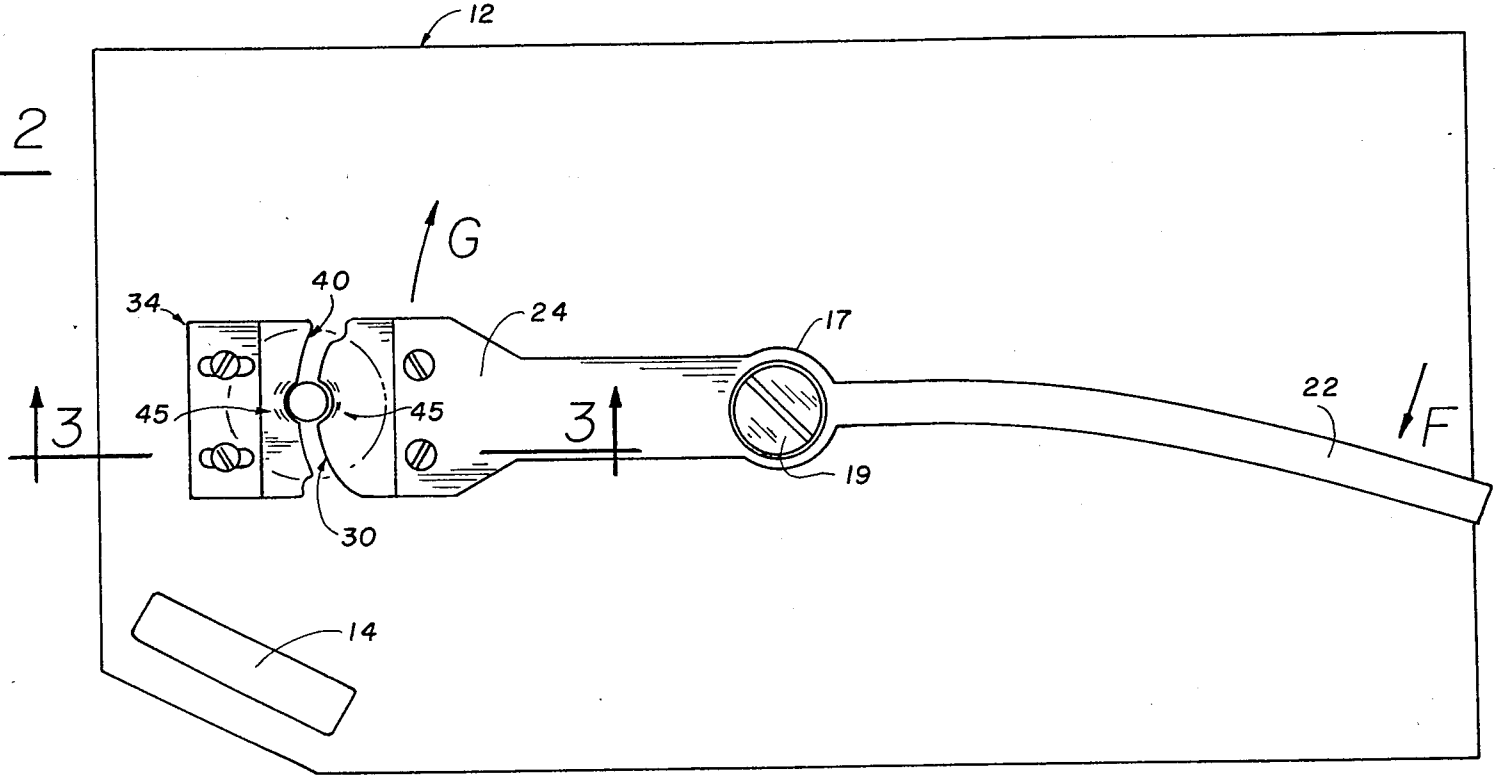
FIG. 2 is a top plan view of the assembly of FIG. 1 with the top and lever means in mid-launch position.
Figure 3:
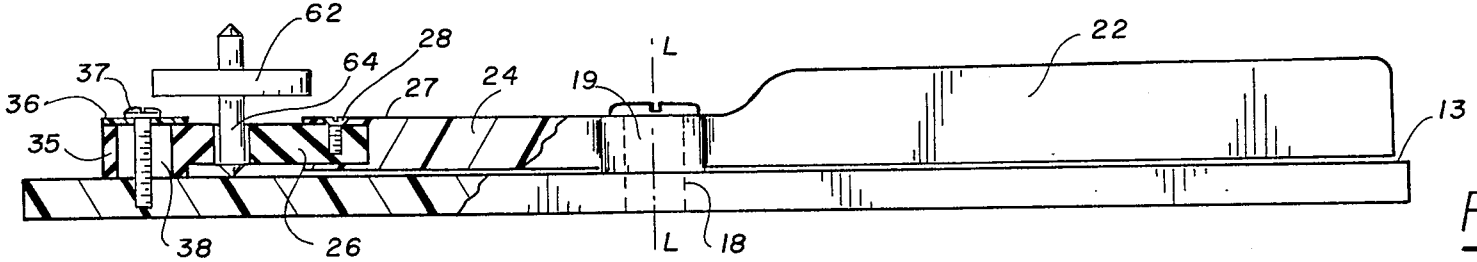
FIG. 3 is a cross-sectional view taken along lines 3—3 of FIG. 2.

With reference now to the drawings, a typical top is shown by reference 60. The top is provided with a symmetrical body 62 which is spun about a round spindle 64. The spindle extends through the axis of symmetry T,T of the body. The invention is suitable for all types and designs of tops having the above basic elements.

The overall spinning assembly of the invention is shown generally by reference 10. The assembly or apparatus includes a base 12 comprising a thin portable platform having a flat top surface 13. The base is rigid and generally rectangular in shape. It may have a variety of shapes as dictated by children's interests and marketing requirements.

The base can include a handle means to facilitate its use. As shown, this comprises rectangular grip opening 14 adjacent a corner of the base. Additional openings, opening shapes and locations could be used. Also, the handle means could comprise handle bar parts or other manual grasping means which may extend from above or below the base.

Pivoted to the base surface 13 is a lever means. This comprises an elongated, generally straight, lever member 16 having a middle portion hub 17 with a center opening 18. Pivot pin 19 extends through the opening and is fixed to the base by threaded fastening means known in the art. The pivot pin axis L,L is perpendicular to base surface 13 and defines the axis of rotation of the lever member.

The portion of the lever member extending outwardly from hub 17 is defined as actuator arm 22. This portion is preferably flexible and provides the leverage surface upon which force is imparted for rotation about the pivot pin.

The portion of the lever member extending inwardly from hub 17 comprises impeller arm 24. The impeller arm may be rigid and have a shorter length than actuator arm 22. It may also include an adjustable grip means at its outer end portion. As shown, this comprises grip head 26 attached to arm yoke 27 by grip fasteners 28. The fasteners may extend through slotted openings in the grip head to permit adjustment or alignment in a manner to be hereinafter referenced.

The outer end of the grip head is convex surface 30. This surface is preferably resilient and vertically straight with a normal axis x,x that is parallel to pivot axis L,L. The convex surface may be roughened, grooved, or serrated to improve its dynamic gripping ability. Its curvature may also be varied as will be hereinafter described.

Adjustably fixed to base surface 13, radially outward from convex surface 30, is post means 34. The post means comprises post block 35 having an overlying retainer strip 36. Block fasteners 37 extend through block slots 38 into base 12 for securing the block to the base. The slots and block fasteners provide an adjustment means for varying the spacing and alignment between the block and lever member.

The post block includes an inwardly facing concave surface 40 that is directly opposite, when aligned therewith, the convex surface 30. At least a portion of the concave surface is coextensive with, and uniformly spacedapart from, the convex surface. Such coextensive surfaces are preferably segments of a right circular cylinder or cylindroid with the concave surface normal axis x′,x′ parallel to axis x,x of the convex surface. The matching surfaces could be tilted, however, to impart angled flights to a top propelled therefrom.

Figure 4:
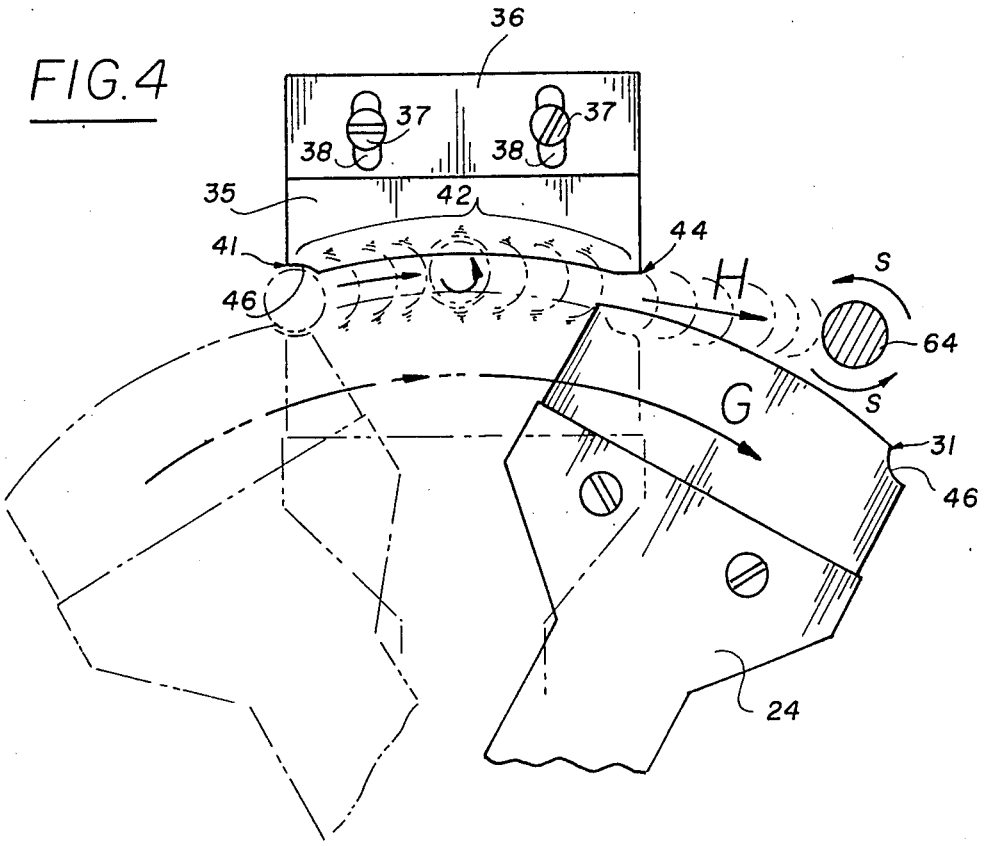
FIG. 4 is an enlarged fragmentary plan view illustrating use of the invention for maximum spin torque and propulsion.

With reference to FIG. 4, both the concave surface and convex surface are circular arcs. They have equal radii with respective axis of rotation spaced-apart on lever arm axis Y,Y by an amount less than the diameter of spindle 64. The convex surface includes leading edge 31 from which extends a drive portion 32. The drive portion extends lengthwise to a trailing edge 33.

In a similar manner, the concave surface 40 comprises an initial contact corner 41 from which extends a spin section 42. The spin section extends lengthwise along the face and merges into a release section 43. The release section includes release edge 44 at the end of the concave surface.

When the convex and concave surfaces are mutually co-extensive lengthwise (equi-length) and have identical axes as a result of having equal radii with respective axes on the impeller arm longitudinal axis Y,Y, spindle 64 will be gripped throughout its travel across the surfaces. In such case, the release section will comprise release edge 44 and a top spun therethrough will receive the greatest torque and propulsion forces.

Figure 5:
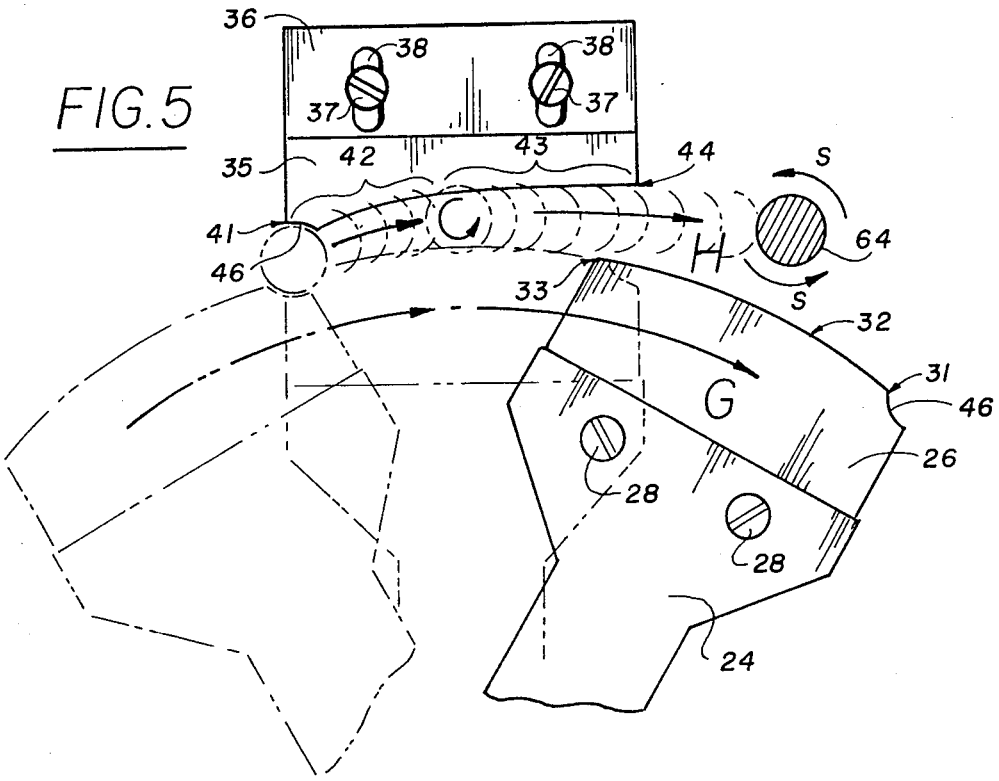
FIG. 5 is an enlarged fragmentary plan view illustrating use of the invention with an alternative surface curvature.

If the concave surface diverges from the convex surface as shown in FIG. 5, the release section will be defined as the region where the spacing between surfaces begins to exceed the diameter of spindle 64. Such divergence can result from any one or combination of the following: (1) Increasing the radius of curvature of surface 41; (2) Diminishing the radius of curvature of surface 30; (3) altering alingment of grip head 26; (4) Offsetting the axis of curvature from the impeller arm axis Y,Y; and/or (5) Loosening block fasteners 37 and skewing post block 35.

To facilitate engagement of the top into the nip between the surfaces, a top connector means may be used. Such means may comprise releasable fasteners, clips, pins, fabric fasteners or ties, magnetic parts, releasable adhesive coatings or utilizing cooperating structural configurations of each surface. In the latter case, the surfaces may simply be resilient so that when contact corner 41 and leading edge 31 are positioned directly opposite each other, spindle 64 may be wedged into the nip between the surfaces. It is also helpful to include corresponding notches 46 at the contact corner and leading edge.

With reference to FIGS. 4 and 5, spindle 64 is shown in phantom as being located in cooperating notches 46 of grip head 26 when the impeller arm is in prelaunch position. Actuator arm 22 is then rapidly thrust in the direction of arrow F. This will result in an opposite rotation of impeller arm 24 as shown by arrows G. Frictional engagement of the spindle circumference will cause it to roll about axis T,T as shown by arrows S in direct relation to the movement of convex surface 30 across the stationary concave surface 40.

Assuming no slippage, the spindle will make as many revolutions as its circumference is divided into the length of the respective spin section and drive portion. That is, the top will be forcefully spun as long as the spindle remains within the grip of the spaced-apart curved surfaces. In this regard, note creases 45 in the resilient surfaces caused by the spindle at the midpoint of its translational displacement.

FIG. 4 depicts the maximum in spin force or torque since the surfaces have identical arcs. When trailing edge 33 passes by release edge 44, the spindle will be suddenly released from constraint and the translational force shown by arrows H will carry it away from the surfaces. The sudden release will also permit the creases 45 to return to an unstressed state while simultaneously adding to the force of propulsion.

The divergent surfaces depicted in FIG. 5 allow a mid-surface spindle release. In this case, the divergent surfaces serve as guidance means whereby the top can be more accurately directed to a predetermined location. This feature is desirable in games where placement of the top is important.

While the invention has been described with respect to preferred embodiments, it will be apparent to those skilled in the art that various modifications and improvements may be made without departing from the scope and spirit of the invention. Accordingly, it is to be understood that the invention is not to be limited by the specific illustrative embodiments, but only by the scope of the appended claims.

I claim:

1. A spinning assembly for a top having a spindle about which the top spins, comprising:

a base;

a post means fixed to said base having a concave face;

a lever means pivotally fixed to said base having an actuating arm and an impeller arm;

said impeller arm including an impeller head having a convex face at least a portion of which is spaced radially apart a predetermined distance from said concave face for gripping said spindle, said faced including an adjustment means for varying said distance, said concave face having an initial contact corner and said convex face having a leading edge; and, a top connector means for disposing said top adjacent said faces prior to spinning selected from the group consisting of fastener, clip, pin, fabric tie, adhesive coating, cloth fastener, magnetic grip and corresponding notches in said contact corner and leading edge.

2. The assembly of claim 1 wherein said concave face includes a spin section extending from said contact corner that merges into a release section, said release section including a release edge.

3. The assembly of claim 2 wherein said convex face includes a drive portion extending from said leading edge and terminates at a trailing edge.

4. The assembly of claim 3 wherein said concave face and said convex face are defined by respective arcs of equal curvature having a common radius.

5. The assembly of claim 4 wherein said arcs have equal length whereby said spindle is gripped throughout the length of each face.

6. The assembly of claim 3 wherein said release section diverges from said drive portion.

7. The assembly of claim 3 where said base includes handle means for manually holding said assembly.

8. The assembly of claim 1 wherein said adjustment means comprises slotted fastening means for securing said post means to said base.

9. The assembly of claim 1 wherein said actuating arm is flexible and at least one of said faces is resilient.

10. A spinning apparatus for a top, said top comprising a symmetrical body which is spun about a spindle that extends through the axis of symmetry of the body, wherein the improvement comprises:

a base;

a lever pivoted to said base comprising an impeller arm with an outer end defining a convex surface and an actuating arm connected to said impeller arm;

a post secured to said base adjacent said outer end having a concave surface which is spaced from said convex surface a distance less than the diameter of said spindle whereby relative motion between said surfaces with said spindle disposed therebetween will impart a spinning motion to said top and propel it outwardly from said surfaces;

said surfaces including a top connector means for disposing said top in a pre-launch position relative to said surfaces selected from the group consisting of fastener, clip, pin, fabric tie, adhesive coating, cloth fastener, magnetic grip and corresponding notches in said surface; and, adjustment means for varying the distance between said surfaces.

11. The apparatus of claim 10 wherein at least a portion of said surfaces are coextensive and uniformly spaced apart.

12. The apparatus of claim 11 wherein said portion is defined by identical arcs having axes common to the longitudinal axis of said impeller arm.

13. The apparatus of claim 11 wherein said lever includes a flexible actuating arm for moving said impeller arm relative to said concave surface.

14. The apparatus of claim 10 wherein said surfaces correspond to segments of a right circular cylinder or cylindroid, each having a normal axis disposed about parallel to the pivot axis of said lever.

* * * * *